US008653373B2

(12) United States Patent
Sugiyama et al.

(10) Patent No.: US 8,653,373 B2
(45) Date of Patent: Feb. 18, 2014

(54) DIFFERENTIAL SIGNAL TRANSMISSION CABLE AND METHOD FOR FABRICATING THE SAME

(75) Inventors: Takahiro Sugiyama, Hitachi (JP); Hideki Nonen, Hitachi (JP); Takashi Kumakura, Hitachinaka (JP)

(73) Assignee: Hitachi Cable, Ltd., Tokyo (JP)

( * ) Notice: Subject to any disclaimer, the term of this patent is extended or adjusted under 35 U.S.C. 154(b) by 258 days.

(21) Appl. No.: 13/137,815

(22) Filed: Sep. 14, 2011

(65) Prior Publication Data

US 2012/0193122 A1 Aug. 2, 2012

(30) Foreign Application Priority Data

Jan. 27, 2011 (JP) ..... 2011-015010

(51) Int. Cl.
*H01B 11/00* (2006.01)
*H01B 13/08* (2006.01)

(52) U.S. Cl.
USPC ..... 174/113 R; 29/825

(58) Field of Classification Search
CPC ..... H01B 11/00; H01B 13/08
USPC ..... 174/113 R; 29/825
See application file for complete search history.

(56) References Cited

U.S. PATENT DOCUMENTS

2004/0026101 A1 2/2004 Ochi

FOREIGN PATENT DOCUMENTS

JP 2002-289047 10/2002

*Primary Examiner* — Timothy Thompson
*Assistant Examiner* — Charles Pizzuto
(74) *Attorney, Agent, or Firm* — McGinn IP Law Group, PLLC

(57) ABSTRACT

A differential signal transmission cable has a pair of insulated wires, a first tape and a second tape. Each of the first and second tapes is made of a base material having an electrical insulating property and an electrical conductive film formed on at least one surface of the base material. The first tape is spirally wound around the insulated wires such that the electrical conductive film is provided outside. The second tape is spirally wound around the first tape such that the electrical conductive film of the second tape contacts with the electrical conductive film of the first tape. Among angles made by an upper edge of the insulated wires and an edge of the first tape in a side view, a first angle made on one end side of the insulated wires is an acute angle in the first tape.

6 Claims, 5 Drawing Sheets

DIFFERENTIAL SIGNAL TRANSMISSION CABLE AND METHOD FOR FABRICATING THE SAME

The present application is based on Japanese patent application No. 2011-015010 filed on Jan. 27, 2011, the entire contents of which are incorporated herein by reference.

BACKGROUND OF THE INVENTION

1. Field of the Invention

The present invention relates to a differential signal transmission cable and method for fabricating the same.

2. Description of the Related Art

As one example of conventional differential signal transmission cables, Japanese Patent Laid-Open No. 2002-289047 (JP-A 2002-289047) discloses a parallel twin-core shielded electric wire, in which a pair of insulated electric wires are arranged in parallel, at least one drain conductor is arranged in parallel with the insulated electric wires, the pair of insulated electric wires and the drain conductor are wound up collectively with a metal foil tape to provide a shielded conductor, and an outer periphery part of this shielded conductor is covered with a jacket.

According to the parallel twin-core shielded electric wire disclosed by JP-A 2002-289047, it is possible to shorten a time for manufacturing, since the shielded conductor is formed by winding a metal foil tape.

SUMMARY OF THE INVENTION

However, in the parallel twin-core shielded electric wire disclosed by JP-A 2002-289047, the metal foil tape has a double layer structure including a metal foil and a plastic tape. Therefore, a laminate structure in which a metal foil, a plastic tape, a metal foil, and a plastic tape are laminated in this order is generated in a portion overlapped by winding. Namely, the parallel twin-core shielded electric wire disclosed by JP-A 2002-289047 periodically has the overlapped portions in which an electrical connection between the metal foils is electrically insulated by the plastic tape. As a result, there is a problem of so-called "suck out (drop out)" in the parallel twin-core shielded electric wire. The "suck out" is a phenomenon that a transmission characteristic at a specific frequency suddenly drops.

Accordingly, it is an object of the invention to provide a differential signal transmission cable in which the suck out of the transmission characteristic is suppressed, thereby high speed differential signal transmission between electronic devices and in an electronic device can be realized.

According to a feature of the invention, a differential signal transmission cable comprises:

a pair of insulated wires each of which comprises a conductor coated with an insulator;

a first tape comprising a first base material having an electrical insulating property and a first electrical conductive film formed on at least one surface of the first base material, the first tape being spirally wound around the pair of insulated wires that are positioned in parallel with each other such that the first electrical conductive film is provided outside; and a second tape comprising a second base material having an electrical insulating property and a second electrical conductive film formed on at least one surface of the second base material, the second tape being spirally wound around the first tape such that the second electrical conductive film contacts with the first electrical conductive film, in which among angles made by an upper edge of the pair of insulated wires and an edge of the first tape in a side view in which a longitudinal direction of the pair of insulated wires is a horizontal direction, a first angle made on one end side of the pair of the insulated wires is an acute angle in the first tape, in which among angles made by the upper edge of the pair of insulated wires and an edge of the second tape in the side view, a second angle made on the one end side of the pair of insulated wires is an obtuse angle in the second tape.

In the differential signal transmission cable, it is preferable that a first distance that the first tape advances along the longitudinal direction of the pair of insulated wires when the first tape is spirally wound by 360° is different from a second distance that the second tape advances along the longitudinal direction of the pair of insulated wires when the second tape is spirally wound by 360°.

Further, it is preferable that each of the first tape and the second tape is wound around the pair of insulated wires such that ¼ or more of a width of each of the first electrical conductive film and the second electrical conductive film is a width of an overlapped portion.

According to another feature of the invention, a method for fabricating a differential signal transmission cable comprises:

preparing a pair of insulated wires each of which comprises a conductor coated with an insulator;

winding a first tape comprising a first base material having an electrical insulating property and a first electrical conductive film formed on at least one surface of the first base material spirally around the pair of insulated wires that are positioned in parallel with each other such that the first electrical conductive film is provided outside and that among angles made by an upper edge of the pair of insulated wires and an edge of the first tape in a side view in which a longitudinal direction of the pair of insulated wires is a horizontal direction, a first angle made on one end side of the pair of the insulated wires is an acute angle; and winding a second tape comprising a second base material having an electrical insulating property and a second electrical conductive film formed on at least one surface of the second base material spirally around the first tape such that the second electrical conductive film contacts with the first electrical conductive film and that among angles made by the upper edge of the pair of insulated wires and an edge of the second tape in the side view, a second angle made on the one end side of the pair of insulated wires is an obtuse angle.

It is preferable that a first distance that the first tape advances along the longitudinal direction of the pair of insulated wires by winding the first tape by 360° is different from a second distance that the second tape advances along the longitudinal direction of the pair of insulated wires by winding the second tape by 360°.

It is preferable that each of the first tape and the second tape is wound around the pair of insulated wires such that ¼ or more of a width of each of the first electrical conductive film and the second electrical conductive film is a width of an overlapped portion.

Effects of the Invention

According to the present invention, it is possible to provide a differential signal transmission cable in which the suck out of the transmission characteristic is suppressed, thereby high speed differential signal transmission between electronic devices and in an electronic device can be realized.

BRIEF DESCRIPTION OF THE DRAWINGS

Next, the present invention will be explained in more detail in conjunction with appended drawings, wherein:

FIGS. 4A to 4C are explanatory diagrams showing winding processes of a first metal foil tape and a second metal foil tape for the differential signal transmission cable in the embodiment, wherein FIG. 4A is a schematic diagram showing a winding process of the first metal foil tape, FIG. 4B is a schematic diagram showing a winding process of the second metal foil tape, and FIG. 4C is a schematic diagram showing a winding process of the second metal foil tape having step portions (level difference) with a pitch different from a pitch of step portions (level differences) of the first metal foil tape; and FIGS. 5A and 5B are graphs showing transmission characteristics of the differential signal transmission cable in the embodiment according to the present invention, wherein FIG. 5A is a graph showing the transmission characteristics of a differential signal transmission cable in which the metal foil tape is wound to provide a single layer structure (single winding) and a differential signal transmission cable in which the metal foil tape is wound to provide a double layer structure (double winding), and FIG. 5B is a graph showing the transmission characteristics of differential signal transmission cables in which a pitch of a first layer and a pitch of a second layer are varied.

DESCRIPTION OF THE PREFERRED EMBODIMENT

Figure 1:
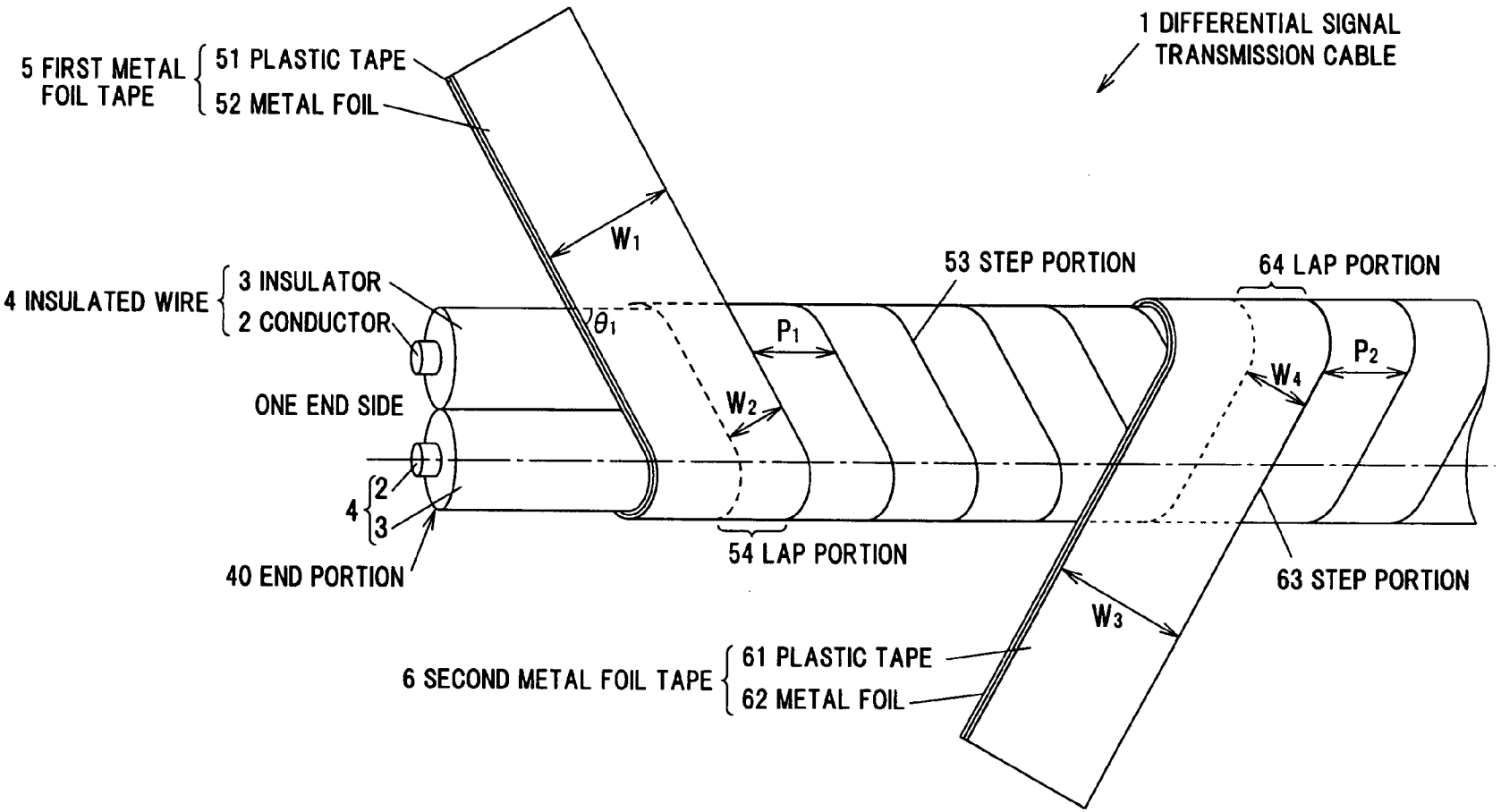
FIG. 1 is a perspective view of a differential signal transmission cable in an embodiment according to the present invention.

Next, a differential signal transmission cable in the embodiment according to the present invention will be explained below in conjunction with appended drawings.

Outline of Embodiments

In the present invention, a differential signal transmission cable comprises a pair of insulated wires each of which comprises a conductor coated with an insulator, a first tape comprising a first base material having an electrical insulating property and a first electrical conductive film formed on at least one surface of the first base material, the first tape being spirally wound around the pair of insulated wires that are positioned in parallel with each other such that the first electrical conductive film is provided outside, and a second tape comprising a second base material having an electrical insulating property and a second electrical conductive film formed on at least one surface of the second base material, the second tape being spirally wound around the first tape such that the second electrical conductive film contacts with the first electrical conductive film, in which among angles made by an upper edge of the pair of insulated wires and an edge of the first tape in a side view in which a longitudinal direction of the pair of insulated wires is a horizontal direction, a first angle made on one end side of the pair of the insulated wires is an acute angle in the first tape, in which among angles made by the upper edge of the pair of insulated wires and an edge of the second tape in the side view, a second angle made on the one end side of the pair of insulated wires is an obtuse angle in the second tape.

In the present embodiment, a method for fabricating a differential signal transmission cable comprises preparing a pair of insulated wires each of which comprises a conductor coated with an insulator, winding a first tape comprising a first base material having an electrical insulating property and a first electrical conductive film formed on at least one surface of the first base material spirally around the pair of insulated wires that are positioned in parallel with each other such that the first electrical conductive film is provided outside and that among angles made by an upper edge of the pair of insulated wires and an edge of the first tape in a side view in which a longitudinal direction of the pair of insulated wires is a horizontal direction, a first angle made on one end side of the pair of the insulated wires is an acute angle, and winding a second tape comprising a second base material having an electrical insulating property and a second electrical conductive film formed on at least one surface of the second base material spirally around the first tape such that the second electrical conductive film contacts with the first electrical conductive film and that among angles made by the upper edge of the pair of insulated wires and an edge of the second tape in the side view, a second angle made on the one end side of the pair of insulated wires is an obtuse angle.

Embodiment (Outline of Structure of a Differential Signal Transmission Cable 1)

FIG. 1 is a perspective view of a differential signal transmission cable 1 in an embodiment according to the present invention. The differential signal transmission cable 1 is e.g. a cable for transmitting differential signals between electronic devices or within an electronic device using differential signals of 10 Gbps or more such as server, router, and storage.

(Differential Signal Transmission)

The differential signal transmission (differential signaling) is to transmit two 180° out-of-phase signals through respective ones of a pair of conductor wires, and at a receiver side, a difference between the two 180° out-of-phase signals is taken out. Since electric currents transmitted through the pair of conductor wires are flown along directions opposite to each other, it is possible to reduce an electromagnetic wave emitted from the conductor wires as transmission paths for the electric current. Further, in the differential signal transmission, external noises are superimposed on the two conductor wires equally, so that it is possible to remove the external noises by taking the difference between the two 180° out-of-phase signals.

(Structure of the Differential Signal Transmission Cable 1)

For example, referring to FIG. 1, the differential signal transmission cable 1 according to the embodiment comprises a pair of insulated wires 4 each of which is formed by coating a conductor (wire) 2 with an insulator 3, a first metal foil tape 5 as a first tape, the first metal foil tape 5 including a plastic tape 51 as a first base material having an electrical insulating property and a metal foil 52 as a first electrical conductive film formed on one surface of the plastic tape 51, the first metal foil tape 5 being spirally wound around the pair of insulated wires 4 that are positioned in parallel with each other such that the metal foil 52 is provided (toward) outside, and a second metal foil tape 6 as a second tape, the second metal foil tape 6 including a plastic tape 61 as a second base material having an electrical insulating property and a metal foil 62 as a second electrical conductive film formed on one surface of the plastic tape 61, the second metal foil tape 6 being spirally wound around the first metal foil tape 5 such that the metal foil 62 contacts with the metal foil 52. As to the first metal foil tape 5, among angles made by an upper edge of the insulated wires 4 and an edge of the first metal foil tape 5 in a side view in which a longitudinal direction of the insulated wires 4 (a dashed line in FIG. 1) is a horizontal direction, a first angle $\theta_1$ made on one end side (i.e. side of an end portion 40) of the insulated wires 4 is an acute angle. Further, as to the second metal foil tape 6, among angles made by the upper edge of the insulated wires 4 and an edge of the second metal foil tape 6 in the side view, a second angle $\theta_2$ (see FIG. 4B) made on the one end side of the insulated wires 4 is an obtuse angle.

(The conductor 2)

The conductor 2 is e.g. a single wire having a good electrical conductivity such as copper or a single metal wire which is plated or the like. The conductor 2 may be e.g. a stranded wire formed by stranding a plurality of conductor wires when a flexural characteristic is regarded to be important.

The insulator 3 is formed by using e.g. a material with a small dielectric constant and a small dissipation factor. For example, polytetrafluoroethylene (PTFE), perfluoroalkoxy (PFA), polyethylene or the like may be used for the material of the insulator 3. The insulator 3 may comprise a foamed insulating resin as a foam material so as to reduce the dielectric constant and the dissipation factor. For example, when the insulator 3 comprises a foamed insulating resin, the insulator 3 may be formed by a method of kneading a foaming agent in a resin and controlling a foaming degree by a molding temperature, and a method of injecting a gas such as nitrogen into a resin by a molding pressure and foaming the resin at the time of releasing the pressure, or the like.

(The First and Second Metal Foil Tape 5 and 6)

The plastic tape 51 of the first metal foil tape 5 and the plastic tape 61 of the second metal foil tape 6 may be formed from e.g. the same material. For example, a resin material such as polyethylene may be used as the material of the plastic tape 51 and the plastic tape 61.

The metal foil 52 and the metal foil 62 may be formed from e.g. the same material. For example, electrical conductive material such as copper, aluminum may be used as the material for the metal foils 52 and 62.

In the present embodiment, each of the first metal foil tape 5 and the second metal foil tape 6 is formed by forming the metal foil on one surface of the plastic tape. However, the present invention is not limited thereto. The metal foil may be formed on both surfaces of at least one of the first metal foil tape 5 and the second metal foil tape 6.

Figure 2:
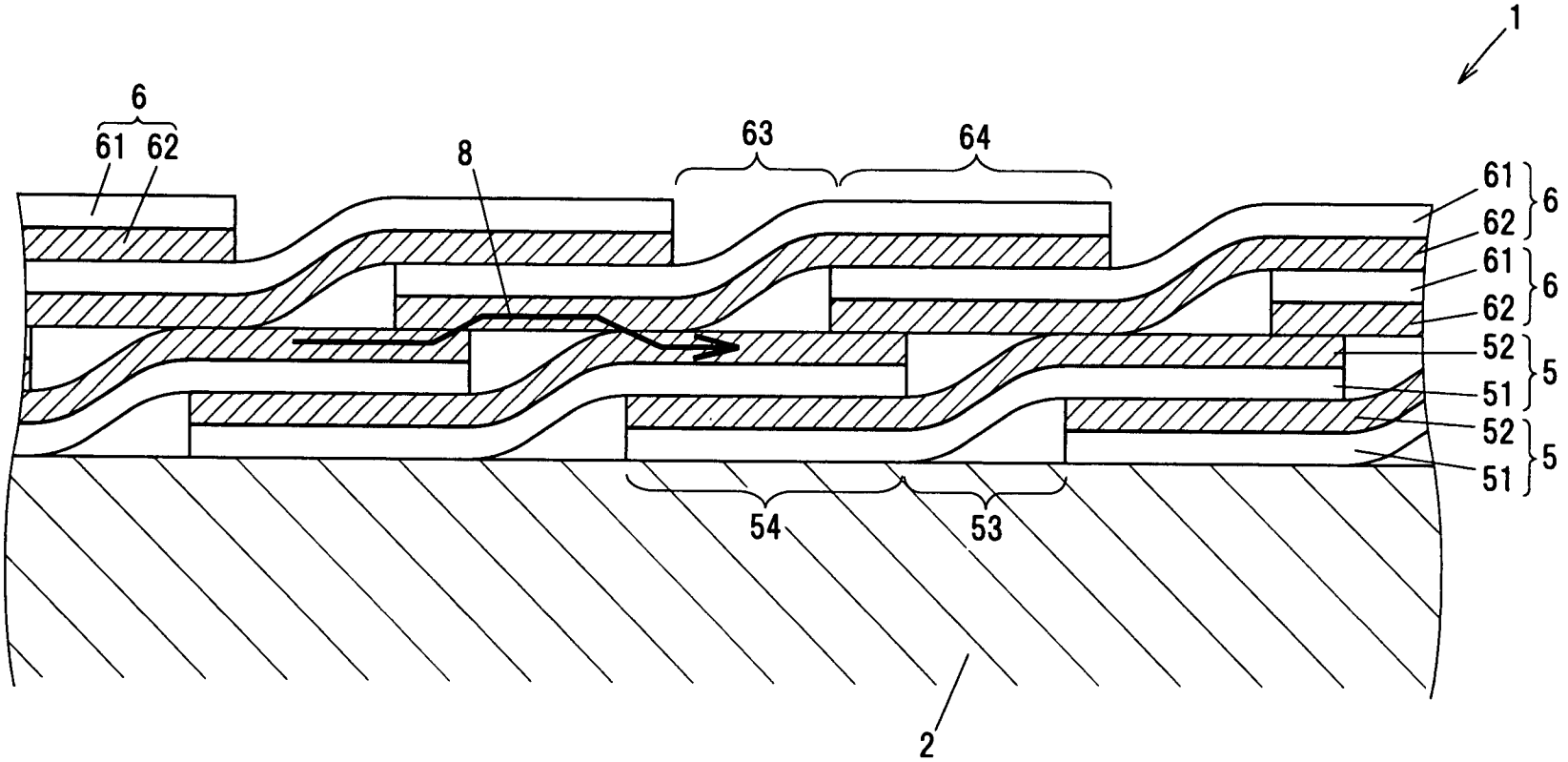
FIG. 2 is a longitudinal cross sectional view of an essential part of a differential signal transmission cable in the embodiment according to the present invention.

FIG. 2 is a longitudinal cross sectional view of an essential part of a differential signal transmission cable 1 in the embodiment according to the present invention.

For example, referring to FIG. 1, the first metal foil tape 5 is wound around the pair of insulated wires 4 with a pitch $P_1$. In FIG. 2, a step portion (level difference) 53 shows a step formed at an edge of the overlapped portion (lap portion 54) where parts of the wound first metal foil tape 5 are overlapped. In a vicinity of an interface between the step portion 53 and the lap portion 54, the metal foil 52 of the first metal foil tape 5 and the metal foil 62 of the second metal foil tape 6 contact with each other. Therefore, the electric current 8 flown through the first metal foil tape 5 is mainly flown along the longitudinal direction of the insulated wires 4.

In the first metal foil tape 5, when a width of the first metal foil tape 5 is a width $W_1$, it is preferable that a width $W_2$ (which is in parallel with the width $W_1$) of the lap portion 54, in which the parts of the first metal foil tape 5 are overlapped, is $W_1/4$ or more. In other words, the first metal foil tape 5 is wound around the pair of insulated wires 4 such that ¼ or more of a width of the first metal foil 52 is a width of an overlapped portion. This value is determined such that the first metal foil tape 5 and the second metal foil tape 6 contact with each other sufficiently and formed integrally with the insulated wires 4 by winding.

Herein, the width $W_2$ should be greater than 0, since the lap portion 54 should exist in the present embodiment.

For example, referring to FIG. 1, the second metal foil tape 6 is wound around the first metal foil tape 5 with a pitch $P_2$. In FIG. 2, a step portion (level difference) 63 shows a step formed at an edge of an overlapped portion (lap portion 64) where parts of the wound second metal foil tape 6 are overlapped. In a vicinity of an interface between the step portion 63 and the lap portion 64, the metal foil 52 of the first metal foil tape 5 and the metal foil 62 of the second metal foil tape 6 contact with each other.

In the second metal foil tape 6, when a width of the second metal foil tape 6 is a width $W_3$, it is preferable that a width $W_4$ (which is in parallel with the width $W_3$) of the lap portion 64, in which the parts of the second metal foil tape 6 are overlapped, is $W_3/4$ or more for the similar reason to the reason of the range of the width $W_2$ of the lap portion 54 in the first metal foil tape 5. In other words, the second metal foil tape 6 is wound around the pair of insulated wires 4 such that ¼ or more of a width of the second metal foil 62 is a width of an overlapped portion.

Similarly, the width $W_4$ should be greater than 0, since the lap portion 64 should exist in the present embodiment.

Herein, the pitch $P_1$ is a distance that the first metal foil tape 5 advances along the longitudinal direction of the insulated wires 4 when the first metal foil tape 5 is spirally wound by 360°. The pitch $P_2$ is a distance that the second metal foil tape 6 advances along the longitudinal direction of the insulated wires 4 when the second metal foil tape 6 is spirally wound by 360°. In other words, the pitches $P_1$ and $P_2$ are intervals between the step portions along the longitudinal direction in the side view of the differential signal transmission cable 1.

Next, referring to FIG. 3, a pitch $P_a$ of junctions (intersecting points) of the first metal foil tape 5 as the first layer and the second metal foil tape 6 as the second layer in the differential signal transmission cable 1 will be explained. Herein, the pitch $P_a$ is not a distance between the junctions, but a distance between straight lines, each of which passes through the junction and is orthogonal to the longitudinal direction in the side view of the differential signal transmission cable 1.

Figure 3:
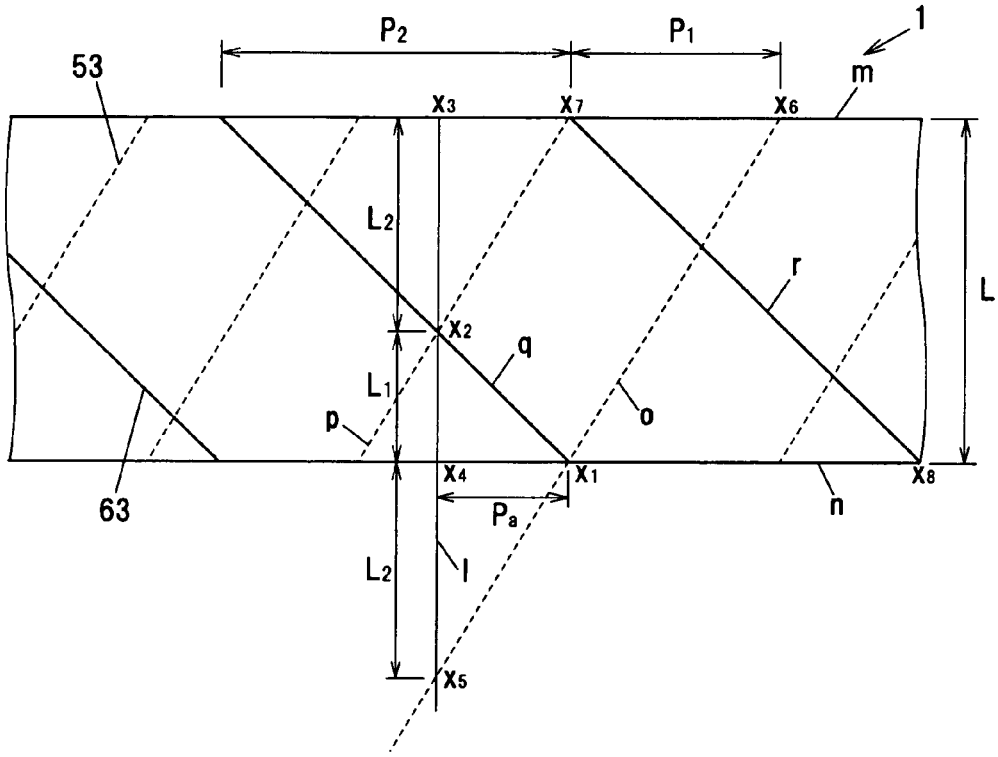
FIG. 3 is an explanatory diagram showing a derivation of a relational formula between junctions and a pitch $P_a$ in the embodiment.

FIG. 3 is an explanatory diagram showing a derivation of a relational formula between the junctions and the pitch $P_a$ in the embodiment. Dotted and inclined lines shown in FIG. 3 indicate the step portions 53 of the first metal foil tape 5. Solid and inclined lines shown in FIG. 3 indicate the step portions 63 of the second metal foil tape 6. A width L shown in FIG. 3 indicates a width of the differential signal transmission cable 1 in its side view. The junctions $x_1$ and $x_2$ shown in FIG. 3 are the junctions of two step portions 53 and one step portion 63, respectively. The junction $x_1$ is an intersecting point of one step portion 53 (an edge thereof is indicated by a straight line o) and one step portion 63 (an edge thereof is indicated by a straight line q) and located on a lower edge n along the longitudinal direction of the differential signal transmission cable 1. The junction $x_2$ is an intersecting point of another step portion 53 (an edge thereof is indicated by a straight line p) next to the one step portion 53 (the line o) and the one step portion 63 (the line q). A junction $x_3$ is an intersecting point of a straight line 1 which is orthogonal to the longitudinal direction in the side view of the differential signal transmission cable 1 and passes through the junction $x_2$ and an upper edge m along the longitudinal direction of the differential signal transmission cable 1 shown in FIG. 3. A junction $x_4$ is an intersecting point of the straight line 1 and the lower edge n along the longitudinal direction of the differential signal transmission cable 1 shown in FIG. 3. A junction $x_5$ is an intersecting point of an extension of the straight line o along the edge of the one step portion 53 which passes through the junction $x_1$ and the straight line 1 which passes through the junction $x_2$. A junction $x_6$ is an intersecting point of the straight line o extended toward the upper portion of the step portion 53 which forms the junction $x_1$ in FIG. 3 and the upper edge m along the longitudinal direction of the differential signal transmission cable 1. A junction $x_7$ is an intersecting point of the straight line p along the edge of the another step portion 53 extended toward the upper portion of the step portion 53 which forms the junction $x_2$ in FIG. 3 and another step portion 63 (an edge thereof is indicated by a straight line r) and located at the upper edge m along the longitudinal direction of the differential signal transmission cable 1. In FIG. 3, this junction $x_7$ is an intersecting point of another step portion 53 (the line p) and another step portion 63 (the line r) as an example. A junction $x_8$ is an intersecting point of the straight line r extended toward a lower portion of the step portion 63 which forms the junction $x_7$ in FIG. 3 and the lower edge n along the longitudinal direction of the differential signal transmission cable 1.

Firstly, referring to FIG. 3, a relationship expressed by a formula (1) is established between a distance $L_1$ between the junctions $x_2$ and $x_3$ and a distance $L_2$ between the junctions $x_2$ and $x_4$:

$$L_1+L_2=L \quad (1).$$

A triangle $x_1$, $x_6$, $x_7$ and a triangle $x_1$, $x_4$, $x_5$ are similar (homothetic) to each other. A triangle $x_1$, $x_7$, $x_s$ and a triangle $x_1$, $x_2$, $x_4$ are similar (homothetic) to each other. The distance $L_1$ and the distance $L_2$ can be calculated by using the distance L, pitch $P_a$, pitch $P_1$ and pitch $P_2$, based on a formula (2) and a formula (3):

$$L_1=L\times P_a/P_1 \quad (2),$$

$$L_2=L\times P_a/P_2 \quad (3).$$

By substituting the formula (1) with the formulas (2) and (3) to calculate the pitch $P_a$, following formula (4) is obtained:

$$P_a=2\times P1\times P2/(P1+P2) \quad (4).$$

For example, when the pitch $P_2$ of the second metal foil tape 6 as the second layer is greater by 10% than the pitch $P_1$ of the first metal foil tape 5 as the first layer, i.e. $P_2/P_1=1.1$ is established, following formula (5) is obtained by using the formula (4):

$$P_a=1.0476P_1 \quad (5),$$

wherein the calculated result is rounded down to four decimal places.

Therefore, when the pitch $P_2$ of the second layer is shifted by 10% from the pitch $P_1$ of the first layer, the junction pitch $P_a$ is different from both of the pitch $P_1$ and the pitch $P_2$ based on the formula (5), so that the junctions are not aligned along the longitudinal direction of the differential signal transmission cable 1.

(Method for Fabricating the Differential Signal Transmission Cable 1)

Next, a method for fabricating the differential signal transmission cable 1 in this embodiment will be explained below. In the following explanation, winding of the first metal foil tape 5 and the second metal foil tape 6 will be mainly described.

Figures 4A, 4B, 4C:
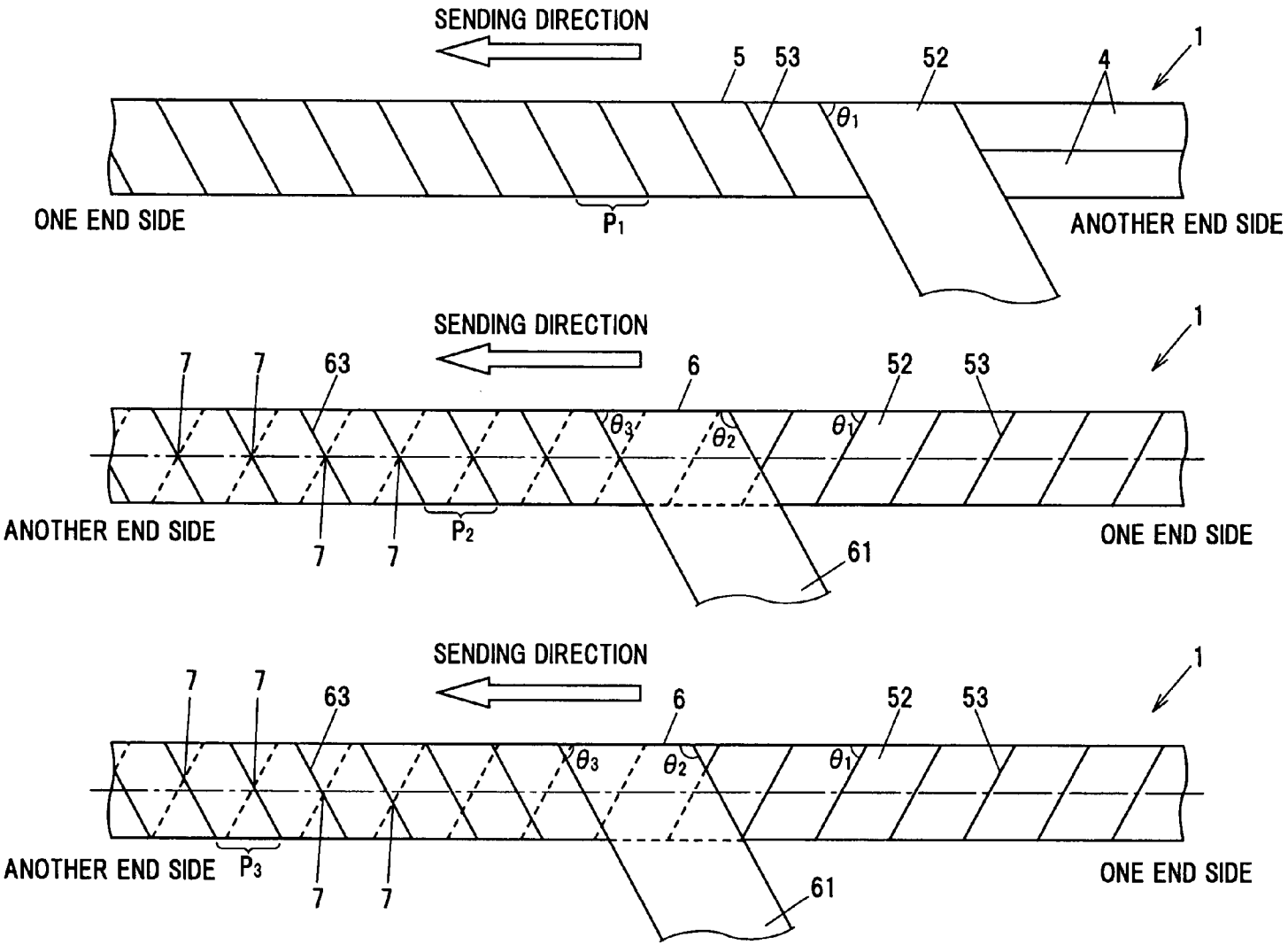

FIGS. 4A to 4C are explanatory diagrams showing winding processes of the first and second metal foil tapes 5, 6 for the differential signal transmission cable 1 in the embodiment. FIG. 4A is a schematic diagram showing the winding process of the first metal foil tape 5 of the differential signal transmission cable 1. FIG. 4B is a schematic diagram showing the winding process of the second metal foil tape 6 of the differential signal transmission cable 1. FIG. 4C is a schematic diagram showing the winding process of the second metal foil tape 6 having the step portions 63 with the pitch P2 different from the pitch P1 of the step portions 53 of the first metal foil tape 5. FIG. 4A shows a first angle $\theta_1$ made by the longitudinal direction of the pair of insulated wires 4 and an edge of the first metal foil tape 5 at the one end side. The end portion 40 is located at a left side in FIG. 4A. FIGS. 4B and 4C show a second angle $\theta_2$ made by the longitudinal direction of the pair of insulated wires 4 and an edge of the second metal foil tape 6 at the one end side. The end portion 40 is located at a right side in FIGS. 4B and 4C.

Next, the method for fabricating the differential signal transmission cable 1 will be explained in more detail. In this method, the first metal foil tape 5 is wound around the pair of insulated wires 4 while sending the insulated wires 4 along one direction (sending direction). Thereafter, the second metal foil tape 6 is wound around from a termination side of the wound first metal foil tape 5.

At first, insulated wires 4 each of which is formed by coating a conductor 2 with an insulator 3 are prepared.

Next, referring to FIG. 4A, a first metal foil tape 5 including a plastic tape 51 having an electrical insulating property and a metal foil 52 formed on a surface of the plastic tape 51 is spirally wound around the pair of insulated wires 4 that are positioned in parallel with each other such that the metal foil 52 is provided outside and a first angle $\theta_1$ made by the longitudinal direction of the pair of insulated wires 4 and an edge of the first metal foil tape 5 on the one end side is an acute angle, among angles made by an upper edge of the insulated wire 4 and the edge of the first metal foil tape 5 in a side view in which a longitudinal direction of the insulated wire 4 is a horizontal direction.

More concretely, the pair of insulated wires 4 are sent toward the left direction from the right direction in FIG. 4A. The first metal foil tape 5 is spirally wound around the pair of insulated wires 4 with the pitch $P_1$ at the first angle $\theta_1$.

Next, a second metal foil tape 6 including a plastic tape 61 having an electrical insulating property and a metal foil 62 formed on a surface of the plastic tape 61 is spirally wound around the first metal foil tape 5 such that the metal foil 62 contacts with the metal foil 52 and a second angle $\theta_2$ made by the longitudinal direction of the pair of insulated wires 4 and an edge of the second metal foil tape 6 on the one end side is an obtuse angle, among angles made by the upper edge of the insulated wire 4 and the edge of the second metal foil tape 6 in a side view in which a longitudinal direction of the insulated wire 4 is a horizontal direction. After carrying out known processes, the differential signal transmission cable 1 is obtained.

More concretely, the pair of insulated wires 4 are sent from the termination side of the wound first metal foil tape 5, i.e. toward the left direction from the right direction in FIG. 4B. The second metal foil tape 6 is spirally wound around the first metal foil tape 5, which is wound around the pair of insulated wires 4, with the pitch $P_2$ at the second angle $\theta_2$.

FIG. 4B shows the differential signal transmission cable 1, in which the third angle $\theta_3$ on another end side and the first angle $\theta_1$ among angles made by the upper edge of the insulated wire 4 and the edge of the second metal foil tape 6 correspond to each other (i.e. the same angle), and the pitch $P_1$ and the pitch $P_2$ correspond to each other (i.e. the same pitch).

FIG. 4C shows the differential signal transmission cable 1, in which the first angle $\theta_1$ and the third angle $\theta_3$ are the same while the pitch $P_1$ and the pitch $P_2$ are different from each other.

(Variation)

The pair of insulated wires 4 may be replaced with a twin-core insulated wire formed by coating a pair of conductors with a single insulator, and the first metal foil tape 5 and the second metal foil tape 6 may be wound around the twin-core insulated wire.

(Measurement Result of the Transmission Characteristics of the Differential Signal Transmission Cable)

Next, measurement result of the transmission characteristics of the differential signal transmission cable will be explained below.

Figure 5A:
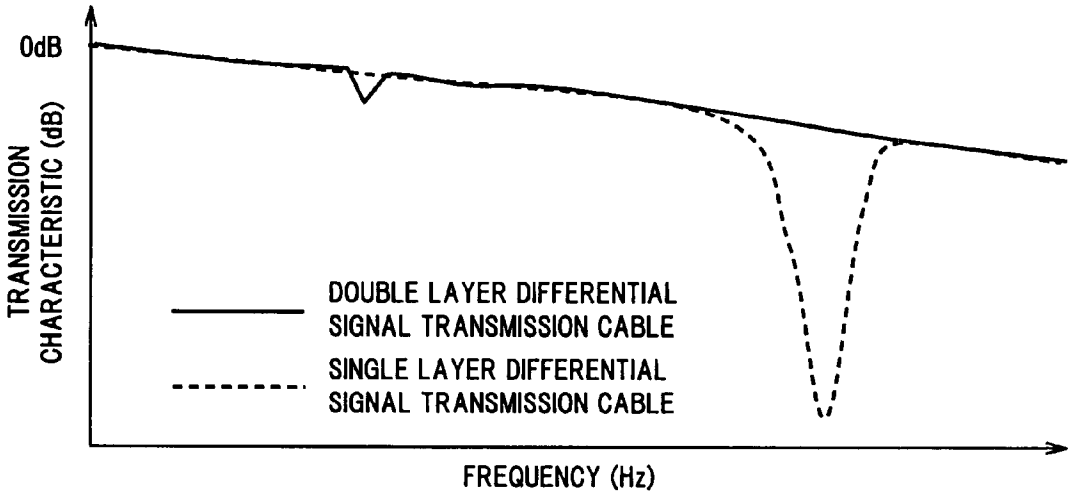
Figure 5B:
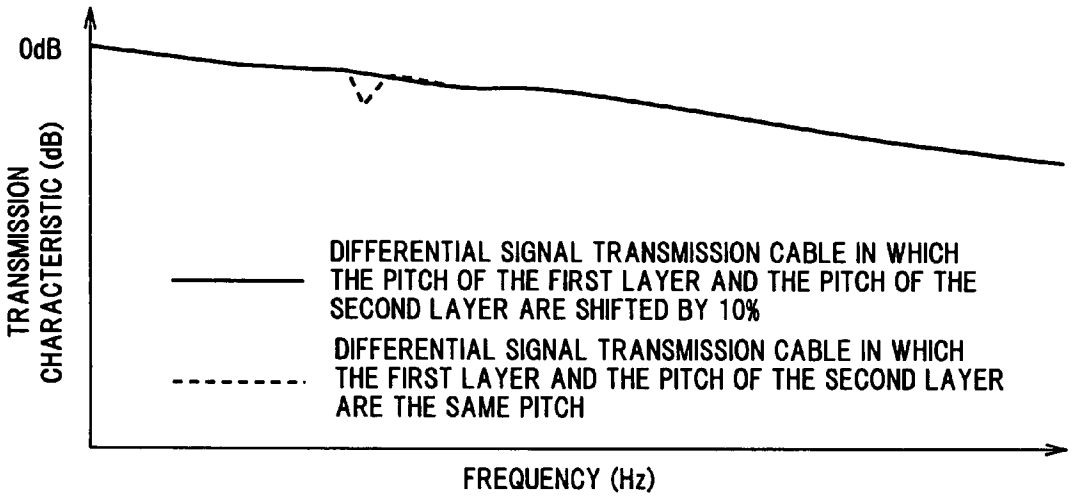

FIG. 5A is a graph showing the transmission characteristics of the differential signal transmission cable in which the metal foil tape is wound by single winding and a differential signal transmission cable in which the metal foil tape is wound by double winding. FIG. 5B is a graph showing the transmission characteristics of differential signal transmission cables in which a pitch of a first layer and a pitch of a second layer are varied.

In FIGS. 5A and 5B, a vertical axis shows the transmission characteristic (dB) and a horizontal axis shows the frequency (Hz).

In FIG. 5A, a solid line shows the transmission characteristic of the differential signal transmission cable in which the metal foil tape is wound by single winding, and a dotted line shows the transmission characteristic of the differential signal transmission cable in which the metal foil tape is wound by double winding. In FIG. 5B, a solid line shows the transmission characteristic of the differential signal transmission cable in which the pitch of the first layer (the first metal foil tape 5) and the pitch of the second layer (the second metal foil tape 6) are different from each other by 10%, and a dotted line shows the transmission characteristic of the differential signal transmission cable in which the pitch of the first layer (the first metal foil tape 5) and the pitch of the second layer (the second metal foil tape 6) are the same.

The measurement of the transmission characteristic of the differential signal transmission cable is carried out by using a 4-port network analyzer. More specifically, port 1 and port 2 are connected to two conductors at one end of the differential signal transmission cable, while port 3 and port 4 are connected two conductors at another end of the differential signal transmission cable. Thereafter, S-parameter (scattering parameter) is measured by a frequency sweeping for each frequency. Successively, the S-parameter obtained by this measurement is synthesized appropriately, so that attenuation characteristic of the differential signal transmission cable, i.e. the transmission characteristic can be obtained. Herein, with the use of a network analyzer (N5230A made by Agilent Technology Co., Ltd.), the transmission characteristic (Sdd21) of a differential output at the ports 3 and 4 was calculated from a differential input at the ports 1 and 2.

Referring to FIG. 5A, in the differential signal transmission cable in which the metal foil tape is wound by single winding, a great fall (suck out) of the transmission characteristic was measured in a high frequency region. The reason of this "suck out" is assumed as follows. In the case of winding the metal foil tape by single winding, the contact between the metal foils is prevented by the plastic tape on which the metal foil is formed so that the metal foils are electrically insulated from each other. Further, such electrically insulated structures exist periodically along the longitudinal direction of the differential signal transmission cable. In general, the "suck out" appears at the frequency of around 12 GHz, for the case of the differential signal transmission cable with a winding pitch of about 30 mm, so that the "suck out" is a great problem in the differential signal transmission at 10 Gbps or more. For example, when the signals are transmitted at a speed of 25 Gbps, the signal will be remarkably attenuated due to the "suck out" at the frequency of around 12 GHz, since the fundamental frequency of the differential signal transmission is 12.5 GHz.

On the other hand, in the differential signal transmission cable 1 in the present embodiment, the metal foil 52 as the first layer and the metal foil 62 as the second layer are electrically connected with each other at the step portion 53 and the step portion 63 as described above. Therefore, as shown in FIG. 5A, the "suck out" can be remarkably suppressed compared with the differential signal transmission cable in which the metal foil is wound around by single winding.

However, as shown in FIG. 5A, a small fall of the transmission characteristic (i.e. a dip) was observed in a low frequency region. This fall is caused by that the junctions 7 shown in FIG. 4B are aligned along the longitudinal direction (a chain line in FIG. 4B) of the differential signal transmission cable 1. In other words, when the pitch $P_1$ of winding the first metal foil tape 5 and the pitch $P_2$ of winding the second metal foil tape 6 are the same, the formed junctions 7 are aligned along the longitudinal direction of the differential signal transmission cable 1, thereby affecting the transmission characteristic.

Accordingly, as shown in FIG. 4C, the differential signal transmission cable 1 with a winding pitch $P_3$ in which the pitch $P_1$ and the pitch $P_2$ are shifted by about 10% was manufactured and the transmission characteristic was measured. For the purpose of comparison, a winding angle of the second metal foil tape 6 of the differential signal transmission cable with the pitch $P_3$ is $\theta_2$ similarly to the winding angle in the differential signal transmission cable shown in FIG. 4B.

In the differential signal transmission cable 1 shown in FIG. 4C, the junctions 7 are not aligned along the longitudinal direction (a chain line in FIG. 4C) of the differential signal transmission cable 1. As to the transmission characteristic of the differential signal transmission cable 1, referring to FIG. 5B, the dip observed in the case that the pitch $P_1$ and the pitch $P_2$ are the same was not caused, so that the "suck out" was suppressed.

Accordingly, in the differential signal transmission cable 1 in this embodiment, it is preferable that the pitch $P_1$ and the pitch $P_2$ are shifted from each other within a range from 10% to 20%. When the difference between the pitch $P_1$ and the pitch $P_2$ is less than 10%, the shift between the junctions is smaller than the above range, so that a width of a region in which the suck out is suppressed is smaller than that in the above range. When the difference between the pitch $P_1$ and the pitch $P_2$ is greater than 20%, although the shift between the junctions is greater than the above range, a process for winding the tape with a narrower pitch is increased. Further, in a process for winding the tape with a wider pitch, the tape is easily released due to wideness of the pitch. Accordingly, it is preferable that the difference between pitch $P_1$ and the pitch $P_2$ falls within the above range.

Effects of the Embodiment

According to the differential signal transmission cable 1 in the embodiment, it is possible to suppress the suck out of the transmission characteristic, thereby high speed differential signal transmission between electronic devices and in an electronic device can be realized.

In other words, although the differential signal transmission cable 1 is provided with the metal foils wound around the insulated wires, the metal foil 52 and the metal foil 62 are electrically connected to each other at the step portion 53 and the step portion 63 generated by winding the metal foils 52 and 62. Therefore, the suck out can be suppressed in comparison with the cable in which the metal foil is wound only once by single winding so that the electrical insulation is caused at the step portion generated by winding the meta foil.

Further, in the differential signal transmission cable 1, the junctions between the first layer and the second layer are not aligned along the longitudinal direction, the suck out can be further suppressed in comparison with the cable in which the junctions between the first layer and the second layer are aligned along the longitudinal direction.

As described above, the differential signal transmission cable 1 in the present embodiment is particularly effective for the differential signal transmission at the speed of 10 Gbps or more.

Further, in the differential signal transmission cable 1, even the cable 1 is bent, the warping or puckering occurs much less than the cable formed by wrapping the conductor with the metal foil along the longitudinal direction. Therefore, the disconnection of the cable hardly occurs.

Still further, as to the first metal foil tape 5 of the differential signal transmission cable 1, the first angle $\theta_1$ made by the longitudinal direction of the pair of insulated wires 4 and an edge of the first metal foil tape 5 on one end side is an acute angle, among angles made by an upper edge of the insulated wire 4 and the edge of the first metal foil tape 5 in a side view in which a longitudinal direction of the insulated wire 4 is a horizontal direction. As to the second metal foil tape 6 of the differential signal transmission cable 1, the second angle $\theta_2$ made by the longitudinal direction of the pair of insulated wires 4 and an edge of the second metal foil tape 6 on the one end side is an obtuse angle, among angles made by the upper edge of the insulated wire 4 and the edge of the second metal foil tape 6 in the side view in which the longitudinal direction of the insulated wire 4 is the horizontal direction.

Accordingly, even though the winding pitches are shifted, the electrical connection between the first metal foil 5 and the second metal foil 6 can be established at the step portion 53 and the step portion 63. Further, in the differential signal transmission cable 1, high precision processing is not required in manufacturing process, thereby the production yield can be improved, as compared with the cable formed by providing the first metal foil tape and the second metal foil tape with the same width and winding the first and second metal foil tapes with a half width pitch.

The conductor 2 in the differential signal transmission cable 1 in the present embodiment is a single wire. However, the present invention is not limited thereto. The conductor 2 may comprises a stranded wire formed by stranding plural conductor wires.

Although the invention has been described, the invention according to claims is not to be limited by the above-mentioned embodiments and examples. Further, please note that not all combinations of the features described in the embodiments and the examples are necessary to solve the problem of the invention.

What is claimed is:

1. A differential signal transmission cable comprising:

a pair of insulated wires each of which comprises a conductor coated with an insulator;

a first tape comprising a first base material having an electrical insulating property and a first electrical conductive film formed on at least one surface of the first base material, the first tape being spirally wound around the pair of insulated wires that are positioned in parallel with each other such that the first electrical conductive film is provided outside; and a second tape comprising a second base material having an electrical insulating property and a second electrical conductive film formed on at least one surface of the second base material, the second tape being spirally wound around the first tape such that the second electrical conductive film contacts with the first electrical conductive film, wherein among angles made by an upper edge of the pair of insulated wires and an edge of the first tape in a side view in which a longitudinal direction of the pair of insulated wires is a horizontal direction, a first angle made on one end side of the pair of the insulated wires is an acute angle in the first tape, wherein among angles made by the upper edge of the pair of insulated wires and an edge of the second tape in the side view, a second angle made on the one end side of the pair of insulated wires is an obtuse angle in the second tape.

2. The differential signal transmission cable according to claim 1, wherein a first distance that the first tape advances along the longitudinal direction of the pair of insulated wires when the first tape is spirally wound by 360° is different from a second distance that the second tape advances along the longitudinal direction of the pair of insulated wires when the second tape is spirally wound by 360°.

3. The differential signal transmission cable according to claim 1, wherein each of the first tape and the second tape is wound around the pair of insulated wires such that ¼ or more of a width of each of the first electrical conductive film and the second electrical conductive film is a width of an overlapped portion.

4. A method for fabricating a differential signal transmission cable comprising:

preparing a pair of insulated wires each of which comprises a conductor coated with an insulator;

winding a first tape comprising a first base material having an electrical insulating property and a first electrical conductive film formed on at least one surface of the first base material spirally around the pair of insulated wires that are positioned in parallel with each other such that the first electrical conductive film is provided outside and that among angles made by an upper edge of the pair of insulated wires and an edge of the first tape in a side view in which a longitudinal direction of the pair of insulated wires is a horizontal direction, a first angle made on one end side of the pair of the insulated wires is an acute angle; and winding a second tape comprising a second base material having an electrical insulating property and a second electrical conductive film formed on at least one surface of the second base material spirally around the first tape such that the second electrical conductive film contacts with the first electrical conductive film and that among angles made by the upper edge of the pair of insulated wires and an edge of the second tape in the side view, a second angle made on the one end side of the pair of insulated wires is an obtuse angle.

5. The method for fabricating a differential signal transmission cable according to claim 4, wherein a first distance that the first tape advances along the longitudinal direction of the pair of insulated wires by winding the first tape by 360° is different from a second distance that the second tape advances along the longitudinal direction of the pair of insulated wires by winding the second tape by 360°.

6. The method for fabricating a differential signal transmission cable according to claim 4, wherein each of the first tape and the second tape is wound around the pair of insulated wires such that ¼ or more of a width of each of the first electrical conductive film and the second electrical conductive film is a width of an overlapped portion.

* * * * *